US005432038A

United States Patent [19]

Katsukawa et al.

[11] Patent Number: 5,432,038

[45] Date of Patent: Jul. 11, 1995

[54] PROCESS FOR PRODUCING AN ORGANIC PHOTOSENSITIVE MATERIAL PREVENTING BLUSHING

[75] Inventors: Masato Katsukawa; Masashi Tanaka, both of Osaka, Japan

[73] Assignee: Mita Industrial Co., Ltd., Osaka, Japan

[21] Appl. No.: 186,912

[22] Filed: Jan. 27, 1994

[30] Foreign Application Priority Data

Jan. 28, 1993 [JP] Japan ..... 5-012843

[51] Int. Cl.[6] ..... G03G 5/06

[52] U.S. Cl. ..... 430/133; 430/134

[58] Field of Search ..... 430/133, 134

[56] References Cited

U.S. PATENT DOCUMENTS

| | | | |
|---|---|---|---|
| 3,849,128 | 11/1974 | Ihara | 430/133 X |
| 3,956,524 | 5/1976 | Weigl | 430/134 X |
| 4,481,273 | 11/1984 | Katagiri et al. | 430/133 X |
| 4,963,453 | 10/1990 | Kinoshita | 430/96 |
| 5,120,627 | 6/1992 | Nozomi et al. | 430/59 |

FOREIGN PATENT DOCUMENTS

| | | |
|---|---|---|
| 0082011 | 6/1983 | European Pat. Off. . |
| 0093331 | 11/1983 | European Pat. Off. . |
| 0406001 | 1/1991 | European Pat. Off. . |

OTHER PUBLICATIONS

Hackh's Chemical Dictionary, 1969, p. 104.

Patent Abstracts of Japan, vol. 7, No. 10 (P-168) (Jan. 14, 1983).

Patent Abstracts of Japan, vol. 14, No. 498 (P-1124) (Oct. 30, 1990).

Patent Abstracts of Japan, vol. 10, No. 132 (P-456) (May 16, 1986).

*Primary Examiner*—Roland Martin

*Attorney, Agent, or Firm*—Sherman and Shalloway

[57] ABSTRACT

A process for producing an organic photosensitive material preventing brushing by applying an organic solvent solution or a dispersion of an organic photosensitive material onto the surface of a blank tube consisting of an electrically conducting substrate such as of aluminum, wherein when the thickness of the blank tube is denoted as t (cm) and the thickness of the photosensitive material layer as d (cm), the thickness of said photosensitive material layer is so set as to satisfy the following equation, $d=kt$, wherein k is a number which is 0.13 or smaller. The brushing can be effectively prevented by controlling only the thickness of the blank tube which is forming the photosensitive layer and the thickness of said photosensitive layer.

7 Claims, 1 Drawing Sheet

PROCESS FOR PRODUCING AN ORGANIC PHOTOSENSITIVE MATERIAL PREVENTING BLUSHING

BACKGROUND OF THE INVENTION

1. Field of the Invention

The present invention relates to a process for producing an organic photosensitive material preventing blushing and, more specifically, to a process which is effective for the production of a single-layer type organic photosensitive material.

2. Description of the Prior Art

At present, organic photosensitive materials (OPCs) have been extensively used as photosensitive materials for the electrostatic photographic devices. The organic photosensitive materials can be roughly divided into those of the single-layer type in which a single layer obtained by dispersing a charge-generating material (CGM) and a charge-transporting material (CTM) in a binder resin, is formed on a blank tube such as of aluminum, and those in which a layer containing CGM and a layer containing CTM are laminated on a blank tube (usually, the CGM is contained in the lower layer).

These organic photosensitive materials are obtained by preparing a coating solution by dissolving or dispersing the CGM and/or the CTM and a binder resin in an organic solvent, applying the coating solution onto the blank tube by using a blade or by immersion, and drying the coating solution.

Generally, however, the coating solution containing CGM contains an organic solvent in large amounts. Due to the latent heat at the time when the solvent vaporizes after it is applied, therefore, the temperature drops on the surface of the film causing the blushing (whitening) to take place easily. In the case of the organic photosensitive material of the laminated type, the problem is not so serious since the CTM layer is formed on the CGM layer. In the case of the single-layer type organic photosensitive material, however, the blushing takes place on the surface of the photosensitive material and the surface becomes rugged. Therefore, the photosensitive material loses properties such as repetition property when used continuously, resistance against ozone and like properties.

SUMMARY OF THE INVENTION

The assignment of the present invention therefore is to provide a process for producing an organic photosensitive material which effectively prevents blushing.

According to the present invention, there is provided a process for producing an organic photosensitive material preventing blushing by applying an organic solvent solution or a dispersion of an organic photosensitive material onto the surface of an electrically conducting substrate, wherein when the thickness of the electrically conducting substrate is denoted as t (cm) and the thickness of the photosensitive material layer as d (cm), the thickness of said photosensitive material layer is so set as to satisfy the following equation (1):

$$d=kt \quad (1)$$

wherein k is a coefficient expressed by the following equation (2):

$$k \leqq \Delta T \cdot C_{SUB} \cdot d_{SUB} / H_{SOLV} \cdot d_{SOLV} \cdot ((1/C)-1) \quad (2)$$

wherein C is a weight percentage of solid components in the solution or the dispersion, $C_{SUB}$ is a specific heat (cal/g·deg) of the electrically conducting substrate, $d_{SUB}$ is a density (g/cm$^3$) of the electrically conducting substrate, $H_{SOLV}$ is a vaporization enthalpy (cal/g) of the organic solvent, $d_{SOLV}$ is a specific gravity (g/cm$^3$) of the organic solvent, and $\Delta T$ is a temperature drop that is allowed during the vaporization of the organic solvent.

DETAILED DESCRIPTION OF THE INVENTION

According to the present invention, quite distinguished effect is exhibited in that the blushing is prevented by controlling only the thickness of an electrically conducting substrate that is supporting a photosensitive material layer and the thickness of the photosensitive material layer.

Figure 1:
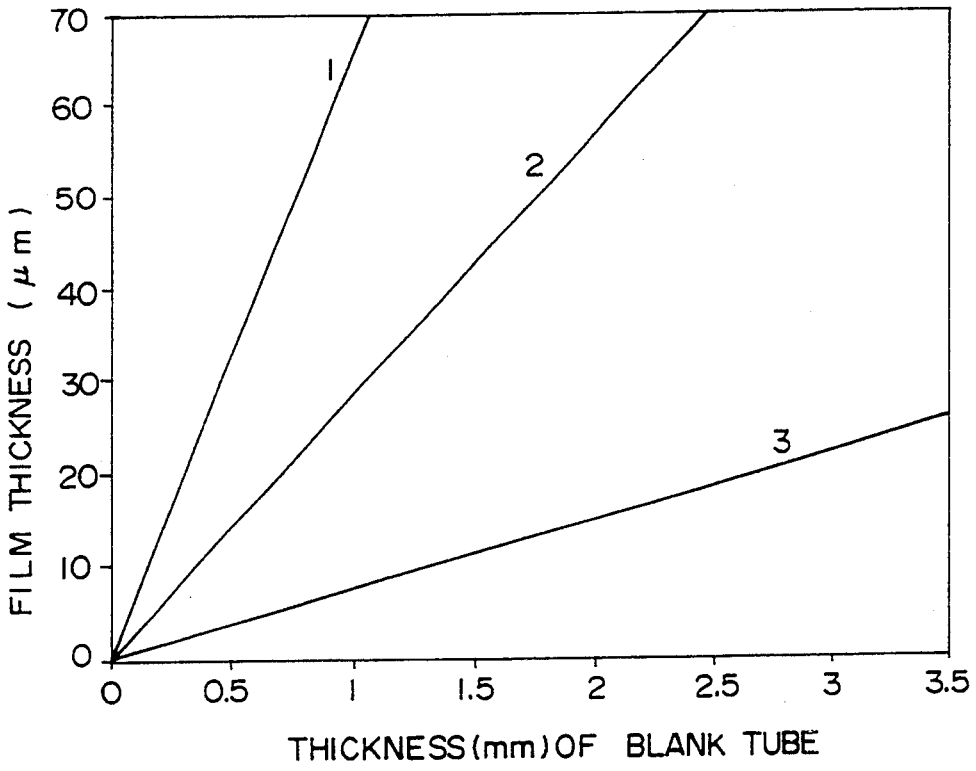
FIG. 1 is a diagram illustrating the regions where no blushing is taking place depending upon the thickness (t) of a blank tube that forms a photosensitive material layer and the thickness (d) of the photosensitive material layer [in an environment of 25° C., humidity 53.8% ($\Delta T=10°$ C.)

The present inventors have conducted extensive study concerning a process for producing an organic photosensitive material by applying an organic solvent solution or a dispersion of an organic photosensitive material onto the surface of an electrically conducting substrate such as an aluminum blank tube followed by drying. The inventors have plotted the thicknesses (d; cm) of the photosensitive material layer relative to the thicknesses (t; cm) of the blank tube that forms the photosensitive material, and have found a novel fact that there exist linear blushing boundary lines as shown in FIG. 1 (the straight lines correspond to those shown in Table 1 appearing later, and wherein the straight line 1 is that of when C=0.5, the straight line 2 is that of when C=0.3, and the straight line 3 is that of when C=0.1)(regions under the boundary lines are those regions where no blushing takes place), and that such boundary lines necessarily exist in any material irrespective of the organic photosensitive materials used for forming the photosensitive material layer or the kind of the blank tube that is the electrically conducting substrate, and have thus completed the present invention.

The reasons why the blushing is effectively prevented when the conditions of the above equation (1) are satisfied in the process of the present invention, are attributed as described below. Here, described below is the case where the blank tube is used as the electrically conducting substrate.

The following equation represents the temperature drop on the surface of the blank tube that takes place when an organic solvent solution or dispersion of an organic photosensitive material (hereinafter often referred to simply as coating solution) is applied onto the blank tube of aluminum or the like to form a film.

$$\text{Temperature drop} = \frac{\text{Latent heat of solvent vaporization}}{\text{Heat capacity of blank tube}}$$

-continued $$= \frac{\text{Film thickness of solvent (thickness of photosensitive layer immediately after coated)} \times \text{Specific gravity of solvent} \times \text{Vaporization enthalpy of solvent}}{\text{Thickness of blank tube} \times \text{specific heat of blank tube} \times \text{density of blank tube}}$$

Here, the film thickness of the solvent can be substituted by the film thickness of the photosensitive layer (thickness of photosensitive layer after dried)×[(1/concentration of solid components)−1].

Therefore, if the thickness of the photosensitive layer is denoted by d (cm) and the thickness of the blank tube by t (cm), the temperature drop $\Delta T_1$ on the surface of the blank tube is given by the following equation (3):

$$\Delta T_1 = d\cdot[(1/C)-1]\cdot d_{SOLV}\cdot H_{SOLV}/t\cdot C_{SUB}\cdot d_{SUB} \quad (3)$$

where C is a concentration (weight percentage) of solid components in said solution or said dispersion, $d_{SOLV}$ is a specific gravity (g/cm$^3$) of the organic solvent, $H_{SOLV}$ is a vaporization enthalpy (cal/g) of the organic solvent, $C_{SUB}$ is a specific heat (cal/g deg) of the blank tube and $d_{SUB}$ is a density (g/cm$^3$) of the blank tube.

In order to prevent the blushing, furthermore, the temperature drop on the surface of the blank tube must be suppressed during the vaporization of the organic solvent. That is, as the temperature drop increases, the water vapor pressure is saturated under the coating environment and the moisture in the air forms dew resulting in the occurrence of blushing. This, on the other hand, means that the temperature drop is allowable if it is within a range in which the water vapor pressure is smaller than the saturation water vapor pressure in the coating environment.

Figure 2:
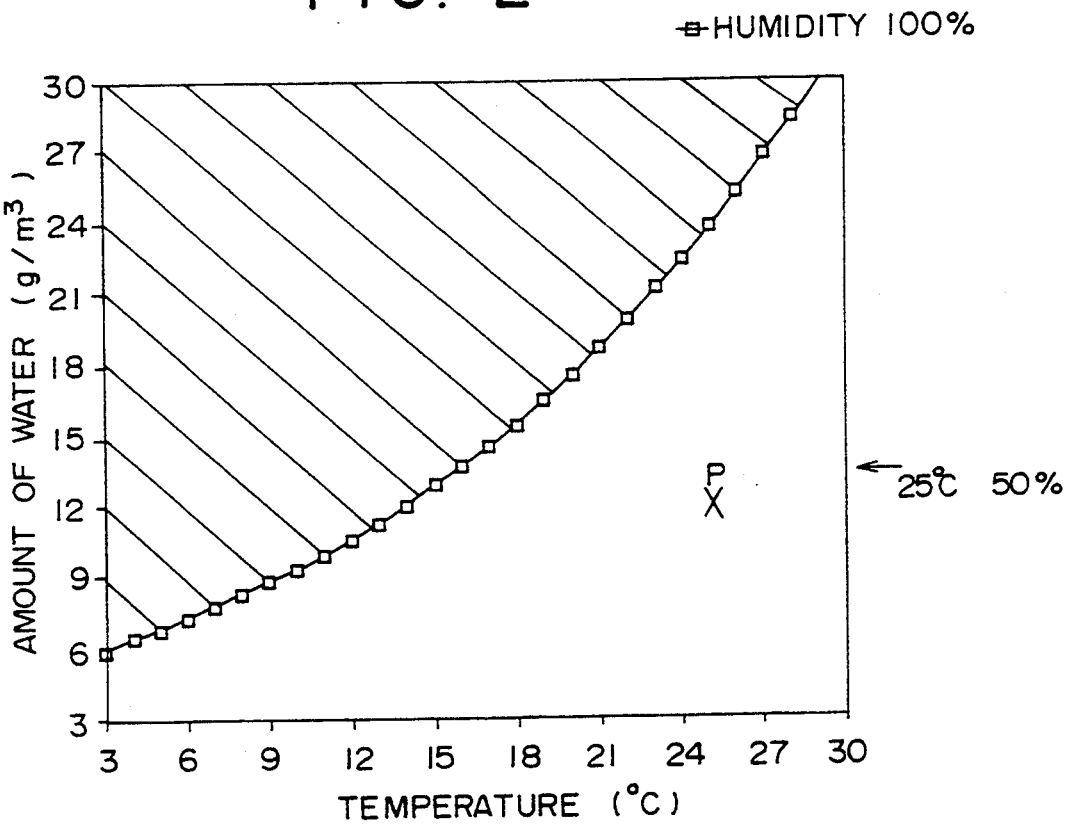
FIG. 2 is a diagram showing temperature vs. saturation amount of water.

FIG. 2 shows a curve (humidity 100%) on which the saturation amount of water is plotted relative to the temperatures, wherein the hatched portion over the saturation amount of water is the region where the blushing takes place. For instance, if the coating is carried out in an environment of 25° C. (saturation amount of water at this temperature is 23.756 g) and a humidity of 50%, the amount of water at 25° C. and a humidity of 50% is calculated to be 11.88 g since, $$\text{Humidity (\%)} = (\text{Amount of water present/Saturation amount of water at that temperature}) \times 100.$$

This working environment is represented by a point P in FIG. 2. Therefore, the temperature at which the amount of water of 11.88 g becomes a saturation amount of water is about 14° C. from FIG. 2. It will be therefore understood that the allowable temperature drop in this case is 11° C.

As will be obvious from the above description, when the allowable temperature drop is ΔT (°C.), the blushing can be prevented under the condition where $\Delta T \geqq \Delta T_1$.

When the above equation (3) is taken into consideration, therefore, the above condition is expressed as $$\Delta T \geqq d\cdot[(1/C)-1]\cdot d_{SOLV}\cdot H_{SOLV}/t\cdot C_{SUB}\cdot d_{SUB}$$

which can, then, be rewritten to derive the following equation (4), $$d \leqq \{\Delta T\cdot C_{SUB}\cdot d_{SUB}/H_{SOLV}\cdot d_{SOLV}\cdot[(1/C)-1]\}\cdot t \quad (4)$$

Therefore, if $\Delta T\cdot C_{SUB}\cdot d_{SUB}/H_{SOLV}\cdot d_{SOLV}\cdot[(1/C)-1]=k^1$ then the condition given by the following equation (5), $$d \leqq k^1 t \quad (5)$$

is the one for preventing the blushing.

According to the above equation, therefore, when the thickness (d) of the photosensitive layer is plotted relative to the thickness (t) of the blank tube, there exists a boundary line of a primary function that defines a region where the blushing does not take place irrespective of what kind of photosensitive material is used. Therefore, $k \leqq k^1$ is set, i.e., the coefficient k is set that satisfies the above-mentioned equation (2), and the photosensitive layer is formed while setting the thickness (t) of the blank tube and the thickness (d) of the photosensitive layer in compliance with the equation (1), thereby to effectively prevent the occurrence of blushing.

According to the present invention, it is desired that the above coefficient k is usually set to be 0.13 or smaller. That is, $k^1$ (that defines the upper limit value of coefficient k) in the above equation (5) is a value determined by the concentration of solid component in the coating solution, kind of solvent, kind of blank tube and conditions in the coating environment. If the conditions which are usually employed are taken into consideration, the coefficient k is set to lie within the above-mentioned range in order to satisfy the conditions represented by the above equation (2).

Electrically Conducting Substrate

According to the present invention, the electrically conducting substrate used for forming the photosensitive layer may be of a tubular shape (blank tube) or a plate shape, and may be made of any single metal such as aluminum, an aluminum alloy, steel, tin, platinum, gold, silver, vanadium, molybdenum, chromium, cadmium, titanium, nickel, palladium, indium, a stainless steel, brass or the like.

Coating Solution

As a coating solution to be applied onto the surface of the above substrate, there is used a solution that is obtained by dissolving or dispersing a charge-transporting substance and a charge-generating substance in a resin solution that is known per se. The coating solution is applied and the solvent is then vaporized in order to form a photosensitive layer of the type of single dispersion layer.

Examples of the charge-transporting substance include fluorenone-type compounds such as chloranil, tetracyanoethylene, 2,4,7-trinitro-9-fluorenone, and the like; nitro compounds such as 2,4,8-trinitrothioxanthone, dinitroanthracene and the like; hydrazone-type compounds such as N,N-diethylaminobenzaldehyde, N,N-diphenylhydrazone, N-methyl-3-carbazolylaldehyde, and the like; oxadiazole-type compounds such as 2,5-di(4-dimethylaminophenyl)-1,3,4-oxadiazole and the like; styryl-type compounds such as 9-(4-diethylaminostyryl) anthracene and the like; carbazole-type compounds-such as N-ethylcarbazole and the like; pyrazoline-type compounds such as 1-phenyl-3-(p-dimethylaminophenyl) pyrazoline and the like; oxazole-type compounds such as 2-(p-diethylaminophenyl)-4-(p-dimethylaminophenyl)-5-(2-chlorophenyl) oxazole and the like; isooxazole-type compounds; thiazole-type compounds such as 2-(p-diethylaminostyryl)-6-diethylaminobenzothiazole and the like; amine derivatives such as triphenylamine, 4,4'-bis[N-(3-methylphenyl)-N-phenylamino] diphenyl and the like; nitrogen-containing cyclic compounds such as stilbene-type compound, thiadiazole-type compound, imidazole-type compound, pyrazole-type compound, indole-type compound, triazole-type compound and like compounds; condensed polycyclic compounds; succinic anhydride; maleic anhydride; dibromomaleic anhydride; polyvinyl pyrene; polyvinyl anthracene; ethylcarbazole formaldehyde resin, and the like, which may be used in a single kind or in a combination of two or more kinds. The photoconducting polymer such as a poly-N-vinyl carbazole or the like may be used as a binder resin that will be described later.

Examples of the charge-generating substance include a variety of materials that have been known so far, such as pyrylium salt, azo-type compound, dis-azo-type compound, tris-azo-type compound, anthanthrone-type compound, phthalocyanine-type compound, indigo-type compound, triphenylmethane-type compound, threne-type compound, toluidine-type compound, pyrazoline-type compound, perylene-type compound and quinacridone-type compound, which may be used in a single kind or in a combination of two or more kinds.

Examples of the resin that serves as a binder include such polymers as styrene-type polymer, styrene-butadiene copolymer, styrene-acrylonitrile copolymer, stylene-maleic acid copolymer, acrylic polymer, styrene-acrylic polymer, ethylene-vinyl acetate copolymer, polyester, alkyd resin, polyamide, polyurethane, epoxy resin, polycarbonate, polyarylate, polysulfone, diallyl phthalate resin, silicone resin, ketone resin, polyvinylbutyral resin, polyetherresin, phenol resin, as well as photo-curing resins such as epoxy acrylate, urethane acrylate and the like, which may be used in a single kind or in a combination of two or more kinds.

Any suitable organic solvent can be used for dissolving or dispersing the above-mentioned charge-transporting substance, charge-generating substance and resin. Generally, however, an organic solvent having a relatively small vaporization enthalpy is used, such as tetrahydrofurane (THF), toluene, dichloromethane, trichloroethane, or the like.

The coating solution may be further blended with any widely known sensitizers such as halonaphthoquinones, acenaphthylenes and the like, as well as various additives such as plasticizers, ultraviolet ray-absorbing agents, antioxidants and the like, thereby to form a photosensitive layer containing these additives. The above-mentioned coating solution usually contains the charge-transporting substance in an amount of 30 to 120 parts by weight and, particularly, 50 to 100 parts by weight and contains the charge-generating substance in an amount of 0.5 to 20 parts by weight and, particularly, 1 to 5 parts by weight per 100 parts by weight of the above-mentioned resin.

Furthermore, the organic solvent should be used in such an amount that the weight percentage (C) of the solid component is 0.1 to 0.5 and, particularly, 0.25 to 0.35. When the weight percentage of the solid component is lower than the above range, the coating solution drips. When the weight percentage of the solid component is higher than the above range, on the other hand, it becomes difficult to adjust the amount of coating.

Preparation of Organic Photosensitive Material

According to the present invention, the above-mentioned coating solution is applied onto the electrically conducting blank tube or the plate by a widely known means with the exception of setting the photosensitive layer to have a thickness that satisfies the conditions of the aforementioned equation (1) and, then, the organic solvent is removed to obtain an organic photosensitive material of the type of single layer dispersion.

In this case, the thickness of the photosensitive layer that is formed can be easily adjusted by adjusting the rate of coating depending upon the weight percentage of solid components in the coating solution. In applying the coating solution, furthermore, it is desired to so set the conditions of coating environment (i.e., temperature and humidity) that the allowable temperature drop $\Delta T$ is 5° C. or larger and, particularly, from 5° to 20° C. When the coating solution is applied under the conditions of environment in which the allowable temperature drop $\Delta T$ is smaller than 5° C., the temperature drop due to the vaporization of the solvent may exceed the allowable temperature drop making it difficult to so adjust the thickness of the photosensitive layer as to satisfy the aforementioned equation (1).

The photosensitive layer usually has a thickness of 15 μm or larger so that it exhibits its functions to a sufficient degree.

Adjusting the thickness of the photosensitive layer so as to satisfy the aforementioned equation (1) means that the amount of solvent to be removed by vaporization has been determined. Therefore, if the aforementioned equation (1) is satisfied, the temperature drop inevitably becomes smaller than the allowable temperature drop $\Delta T$.

As described above, the present invention makes it possible to produce an organic photosensitive material while effectively suppressing the occurrence of blushing.

EXAMPLE 1

The following three conditions were set as a coating environment:

(i) Temperature: 25° C., humidity: 28.6%, allowable temperature drop $\Delta T$: 20° C., (ii) Temperature: 25° C., humidity: 58.8%, allowable temperature drop $\Delta T$: 10° C., (iii) Temperature: 25° C., humidity: 78.8%, allowable temperature drop $\Delta T$: 5° C.

The allowable temperature drops $\Delta T$ in the environmental conditions were found from FIG. 2.

Furthermore, an N,N,N',N'-tetrakis(3-methylphenyl)-1,3-diaminobenzene was used as the charge-transporting substance, a metal-free phthalocyanine was used as the charge-generating substance, and THF (vaporization enthalpy: 116.1 cal/g, specific gravity: 0.88 g/cm$^3$) was used as the organic solvent to prepare coating solutions having weight percentages (C) of solid components shown in Table 1.

Here, in forming the photosensitive layers by applying the above-mentioned coating solutions to the aluminum blank tube (thickness: 1.5 cm, specific heat: 0.2297 cal/g·deg, density: 2.6989 g/cm$^3$) under the above-mentioned environmental conditions, the conditions of the equation (5) for preventing the blushing were shown in Table 1 below relying upon the coefficient $k^1$ calculated from the following equation, $$k^1 = \Delta T \cdot C_{SUB} \cdot d_{SUB} / H_{SOLV} \cdot d_{SOLV} \cdot ((1/C) - 1)$$

TABLE 1

| Weight percentage C of solid component in coating solution | Conditions in coating environment | | |
|---|---|---|---|
| | (i) ΔT:20° C. | (ii) ΔT:10° C. | (iii) ΔT:5° C. |
| 0.1 | d ≦ 0.013484t | d ≦ 0.006742t | d ≦ 0.003371t |
| 0.3 | d ≦ 0.052010t | d ≦ 0.026005t | d ≦ 0.013002t |
| 0.5 | d ≦ 0.121356t | d ≦ 0.060678t | d ≦ 0.030339t |

Blushing has developed in none of the organic photosensitive materials that were prepared under the aforementioned environmental conditions by setting the thickness of the photosensitive layer in compliance with the equation (1) by using a coefficient k which is smaller than $k^1$ that is shown in Table 1. Blushing, on the other hand, has developed in all of the organic photosensitive materials that were prepared in the same manner but using a coefficient k larger than $k^1$.

EXAMPLE 2

A temperature of 25° C. and a humidity of 50% were employed as conditions of the coating environment (allowable temperature drop ΔT: 11° C.), and the coating solution of Example 1 having a weight percentage of solid components of 0.3 was applied onto the aluminum blank tube to form a photosensitive layer that was 20 μm thick. In this case, the coefficient $k^1$ calculated in compliance with the above formula was 0.0286.

Therefore, the condition of the equation (5) for preventing the blushing was $0.002 \leqq 0.0286t$, i.e., $t \geqq 0.07$ (cm), where t is the thickness of the aluminum blank tube.

Aluminum blank tubes of various thicknesses were used to form photosensitive layers of a thickness of 20 μm based upon the above conditional equation. It was found that the blushing did not develop when there were used aluminum blank tubes having thicknesses of 0.07 cm or larger.

We claim:

1. A process for producing an organic electrophotographic photosensitive material under conditions wherein blushing of the electrophotographic photosensitive material is prevented comprising (1) applying a coating of thickness d defined below of an organic solvent solution or dispersion of an organic electrophotographic photosensitive material onto the surface of a tubular or plate shaped electrically conducting substrate comprising a metal or metal alloy, wherein the thickness of the electrically conducting substrate is denoted as t (cm), wherein the thickness d of the coating of electrophotographic photosensitive material layer is so set as to satisfy the following equation (1)

$$d = kt \quad (1)$$

wherein k is a coefficient expressed by the following equation (2)

$$k \leqq \Delta T \cdot C_{SUB} \cdot d_{SUB} / H_{SOLV} \cdot d_{SOLV} \cdot ((1/C) - 1) \quad (2)$$

wherein C is (a) the weight percentage of solid components in the solution or dispersion, $C_{SUB}$ is the specific heat (cal/g·deg) of the electrically conducting substrate, $d_{SUB}$ is the density (g/cm³) of the electrically conducting substrate, $H_{SOLV}$ is the vaporization enthalpy (cal/g) of the organic solvent, $d_{SOLV}$ is the specific gravity (g/cm³) of the organic solvent, and ΔT is a temperature drop that is allowed to occur during the vaporization of the organic solvent, and (2) drying the coating, whereby blushing of the organic electrophotographic photosensitive material is prevented.

2. A process for production according to claim 1, wherein the coefficient k is a number which is 0.13 or smaller.

3. A process for production according to claim 1, wherein said electrophotographic photosensitive material is of the single layer type containing a charge-generating material, a charge-transporting material and a binder resin.

4. A process for production according to claim 1, wherein said weight percentage (C) is from 0.1 to 0.5.

5. A process for production according to claim 1, wherein said temperature drop (ΔT) is from 5° to 20° C.

6. The process according to claim 1 wherein the weight percentage (C) of solid components in the solution or dispersion is in the range of from 0.25 to 0.35.

7. The process according to claim 1 wherein the coating of an electrophotographic photosensitive material is applied at a thickness of at least 15 μm.

* * * * *